US009515381B2

(12) United States Patent
Oh et al.

(10) Patent No.: US 9,515,381 B2
(45) Date of Patent: Dec. 6, 2016

(54) ANTENNA

(71) Applicants: LG INNOTEK CO., LTD., Seoul (KR); INDUSTRY-UNIVERSITY COOPERATION FOUNDATION HANYANG UNIVERSITY, Seoul (KR)

(72) Inventors: Sae Won Oh, Seoul (KR); Hyeong Dong Kim, Seoul (KR); Sin Hyung Jeon, Seoul (KR); Bum Ki Park, Seoul (KR); Jin Hyuk Jang, Seoul (KR)

(73) Assignee: LG INNOTEK, CO., LTD., Seoul (KR)

( * ) Notice: Subject to any disclaimer, the term of this patent is extended or adjusted under 35 U.S.C. 154(b) by 575 days.

(21) Appl. No.: 13/871,741

(22) Filed: Apr. 26, 2013

(65) Prior Publication Data

US 2013/0285872 A1 Oct. 31, 2013

(30) Foreign Application Priority Data

Apr. 27, 2012 (KR) ..... 10-2012-0044991

(51) Int. Cl.
*H01Q 5/00* (2015.01)
*H01Q 1/24* (2006.01)
(Continued)

(52) U.S. Cl.
CPC ..... *H01Q 5/0041* (2013.01); *H01Q 1/243* (2013.01); *H01Q 1/38* (2013.01); *H01Q 5/335* (2015.01); *H01Q 5/357* (2015.01)

(58) Field of Classification Search
CPC ..... H01Q 5/335; H01Q 5/357; H01Q 5/371; H01Q 5/314
See application file for complete search history.

(56) References Cited

U.S. PATENT DOCUMENTS

2001/0054979 A1* 12/2001 Bahr ..... H01Q 1/243 343/700 MS
2004/0087341 A1 5/2004 Edvardsson
(Continued)

FOREIGN PATENT DOCUMENTS

CN 201867863 U 6/2011
CN 102299418 A 12/2011
(Continued)

OTHER PUBLICATIONS

European Search Report dated Aug. 9, 2013 in European Application No. 13157124.2.
(Continued)

*Primary Examiner* — Sue A Purvis
*Assistant Examiner* — Daniel J Munoz
(74) *Attorney, Agent, or Firm* — Saliwanchik, Lloyd & Eisenschenk

(57) ABSTRACT

An antenna according to an embodiment includes a substrate; a radiator; a ground plane spaced apart from the radiator; a feeding pin for feeding an RF signal; a first branch reactance at one side of the feeding pin, the first branch reactance including one end connected to the substrate and an opposite end connected to the ground plane; and a second branch reactance at an opposite end of the feeding pin, the second branch reactance including one end connected to the substrate and an opposite end connected to the ground plane.

11 Claims, 3 Drawing Sheets

(51) Int. Cl.

| | |
|---|---|
| ***H01Q 1/38*** | (2006.01) |
| ***H01Q 5/335*** | (2015.01) |
| ***H01Q 5/357*** | (2015.01) |

(56) References Cited

U.S. PATENT DOCUMENTS

| | | | | |
|---|---|---|---|---|
| 2009/0167617 | A1 | 7/2009 | Nishio | |
| 2009/0278755 | A1 | 11/2009 | Shoji | |
| 2011/0128188 | A1 | 6/2011 | Sakai | |
| 2012/0050121 | A1* | 3/2012 | Kim | H01Q 1/243 343/745 |
| 2013/0169490 | A1* | 7/2013 | Pascolini | H01Q 5/357 343/702 |

FOREIGN PATENT DOCUMENTS

| | | | |
|---|---|---|---|
| JP | 2009-159407 | A | 7/2009 |
| JP | 2009-165003 | A | 7/2009 |
| JP | 2009-278192 | A | 11/2009 |
| JP | 2010-081271 | A | 4/2010 |
| JP | 2011-114818 | A | 6/2011 |
| KR | 10-2011-0019666 | A | 2/2011 |
| WO | WO-02-054534 | A1 | 7/2002 |
| WO | WO-02/054534 | A1 | 7/2002 |
| WO | WO-2010/016298 | A1 | 2/2010 |
| WO | WO-2011/126306 | A1 | 10/2011 |

OTHER PUBLICATIONS

Office Action dated Jul. 9, 2013 in Korean Application No. 10-2012-0044991, filed Apr. 27, 2012.

Office Action dated Mar. 11, 2014, in Japanese Application No. 2013-033305.

Office Action dated Jan. 14, 2015, in Chinese Application No. 201310151625.3.

* cited by examiner

ANTENNA

CROSS-REFERENCE TO RELATED APPLICATION

This application claims the benefit under 35 U.S.C. §119 of Korean Patent Application No. 10-2012-0044991, filed Apr. 27, 2012, which is hereby incorporated by reference in its entirety.

BACKGROUND

The embodiment relates to an antenna.

In recent, as an antenna has been diminished, the radiation efficiency and gain of the antenna are deteriorated, and the bandwidth of the antenna becomes narrower. In spite of the deterioration of the electrical performance, as the demand for the miniaturization, multifunction and wide bandwidth of the mobile terminal have been increased, the miniaturization, multiband and high performance for the antenna have been continuously required.

In the initial stage, a ¼ wavelength monopole antenna is used as an embedded antenna, or a helical type external antenna is mainly used for the mobile terminal. However, these antennas cause inconvenience to a user in carrying the mobile terminal, and radiation efficiency and robustness of the antennas are deteriorated.

In order to solve these problems, studies for the embedded antennas have been actively performed. Specifically, the study for an inverted-F antenna has been performed very actively. Since the inverted-F antenna has the flat plate structure can be fabricated in a simple way, the inverted-F antenna can be easily applied as the embedded antenna, so the inverted-F antenna has been extensively used as an embedded antenna for a mobile terminal.

FIG. 1 is a perspective view showing a general inverted-F antenna of the related art.

Referring to FIG. 1, in order to satisfy the multiband, the general inverted-F antenna includes a radiator 10 having a low-frequency pattern portion 11 and a high-frequency pattern portion 12 and formed in a conductive pattern of a predetermined shape, and a frame having a predetermined shape with a top surface onto which the radiator 10 is assembled and fixedly supported.

A structure of the inverted-F antenna has been variously modified in use.

However, since an embedded antenna such as an inverted-F antenna is installed in a small space, the antenna size is limited, so that the input impedance has a great capacitive reactance with a low resistance. When the reactance is removed by using a matching circuit, the inverted-F antenna has narrowband characteristics rather than wideband characteristics.

Further, because of low-resistance characteristics, the radiation efficiency is decreased, so it is difficult to effectively satisfy the wideband and multiband characteristics required in recent.

BRIEF SUMMARY

The embodiment provides an antenna which may obtain multiband characteristics and wideband characteristics by integrally forming various antennas with a rear case of a mobile terminal and by applying at least one branch reactance and at least one stub to a matching end of the antenna.

The embodiment provides an antenna having a pie structure which may expand a resonant frequency bandwidth by integrally forming various antenna with a rear case of a mobile terminal and by applying a branch reactance to a matching end of the antenna.

An antenna according to an embodiment includes a substrate; a radiator; a ground plane spaced apart from the radiator; a feeding pin for feeding an RF signal; a first branch reactance at one side of the feeding pin, the first branch reactance including one end connected to the substrate and an opposite end connected to the ground plane; and a second branch reactance at an opposite end of the feeding pin, the second branch reactance including one end connected to the substrate and an opposite end connected to the ground plane.

The first branch reactance and the second branch reactance form a plurality of current paths to generate a plurality of resonant frequency bands.

The first branch reactance controls a frequency to allow the antenna to be operated at a high frequency band.

The second branch reactance controls a frequency to allow the antenna to be operated at a low frequency band.

The first branch reactance and the second branch reactance include a capacitive element.

The capacitive element includes a chip capacitor.

The antenna further includes a first stub between the first branch reactance and the second branch reactance to form a current path of the antenna; and a second stub at one side of the second branch reactance to form a current path of the antenna.

A resonant frequency of the antenna is controlled according to at least one of lengths and widths of the first and second stubs.

A resonant frequency of the antenna is controlled according to a gap between the first stub and the first branch reactance or the second stub and the second branch reactance.

The antenna is installed at a rear case of a mobile terminal integrally with the rear case.

The antenna according to the embodiment may be installed in a mobile terminal.

According to the embodiments, the resonant frequency bandwidth can be expanded by integrally forming various antennas with the rear case of the mobile terminal and by applying the branch reactance to the matching end of the antenna.

Further, according to the embodiment, multiband characteristics and wideband characteristics can be obtained by integrally forming various antennas with the rear case of the mobile terminal and by applying at least one branch reactance and at least one stub to the matching end of the antenna.

Meanwhile, other various effects of the disclosure will be directly or indirectly disclosed in the following detailed description of the disclosure.

DETAILED DESCRIPTION

Hereinafter, an exemplary embodiment of the disclosure will be described to be implemented by those skilled in the art in detail with reference to accompanying drawings.

Figure 1:
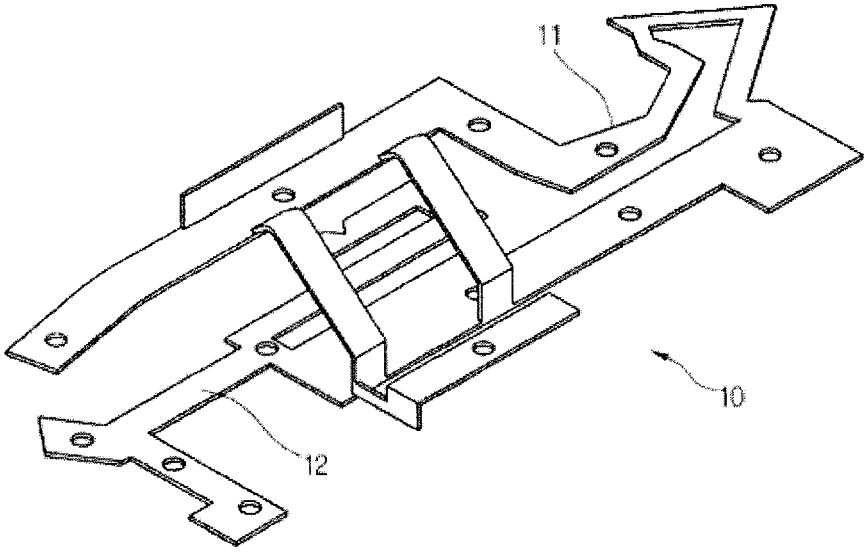
FIG. 1 (Prior Art)
FIG. 1 is a perspective view showing a general inverted-F antenna of the related art.
Figure 2:
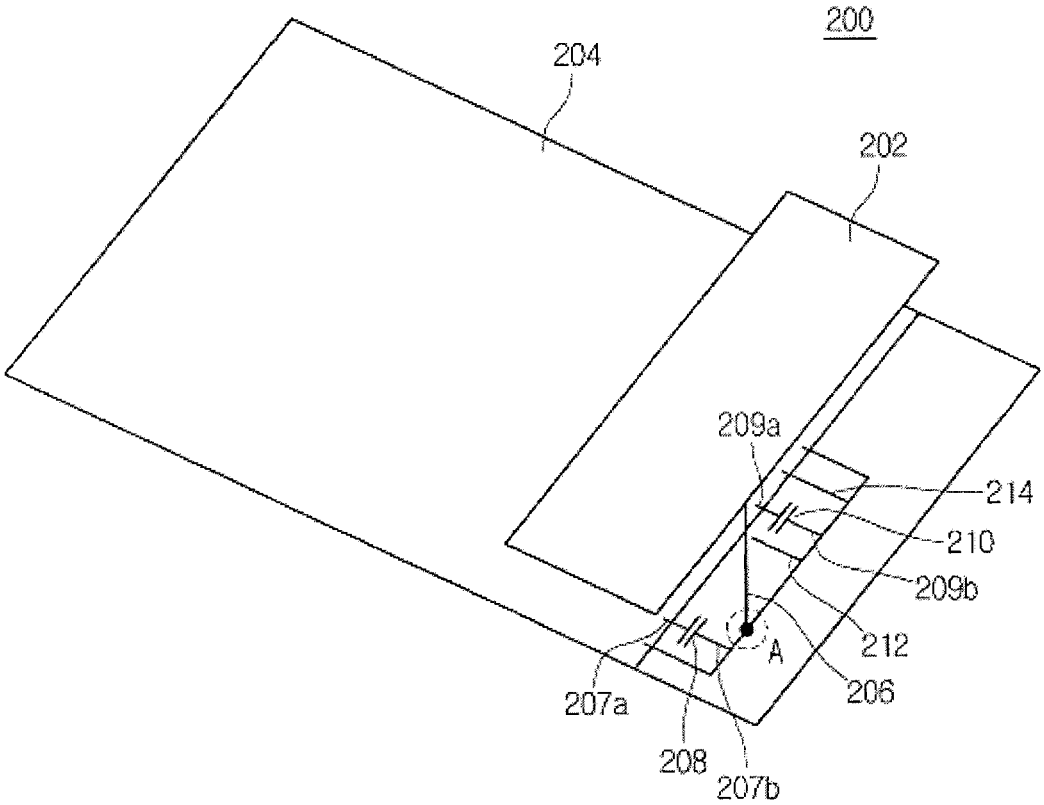
FIG. 2 is a perspective view showing a structure of an antenna according to the embodiment.

FIG. 2 is a view showing a structure of an antenna 200 according to the embodiment.

Referring to FIG. 2, the antenna 200 may include a radiator 202, a ground plane 204, a feeding pin 206, a first branch arm 207*a*, a second branch arm 207*b*, a first branch capacitor 208, a third branch arm 209*a*, a fourth branch arm 209*b*, a second branch capacitor 210, a first stub 212, and a stub 214.

The radiator 202 may radiate a fed RF signal and may receive an RF signal. A size of the radiated or received RF signal may be determined by a shape and size of the radiator 202.

Although the radiator 202 having a plane shape is depicted in FIG. 2, the embodiment is not limited thereto and the radiators 202 having various shapes such as a line shape or a flat plate shape or a meander shape may be used.

In FIG. 2, as in a general inverted-F antenna 200, the radiator 202 is spaced apart from the ground plane 204 by a predetermined distance and in parallel with the ground plane 204. However, the embodiment is not limited thereto, and, in the state that the radiator 202 is maintained in connection with the feeding pin 206, the position of the radiator 202 may be different from that in FIG. 2.

The ground plane 204 may be electrically grounded and may have a predetermined area. When the antenna 200 according to the embodiment is mounted on a mobile terminal, although a substrate of the mobile terminal may be utilized as a ground plane 204, the embodiment is not limited thereto and a separated ground plane 204 may be used.

Here, the mobile terminal may include a cellular phone, a Personal Communication Service (PCS) phone, a GSM phone, a CDMA-2000 phone, Personal Digital Assistants (PDA), a smart phone, and a Mobile Broadcast System (MBS) phone.

Further, the substrate of the mobile terminal may include a Printed Circuit board (PCB) and a Flexible Printed Circuit Board (FPCB).

The feeding pin 206 includes one terminal electrically connected to a feeding point and the other terminal electrically connected to the radiator 202.

The feeding pin 206 receives electric power through a feeding line to feed an RF signal to the radiator 202.

Feeding lines of various types such as a coaxial cable or a micro-strip line may be used.

The first branch arm 207*a* is combined with and extends from the ground plane 204. The second branch arm 207*b* is combined with and extends from a circuit end on the substrate. The first and second branch arms 207*a* and 207*b* are formed of a conductive material, and the first branch capacitor 208 is connected between the first and second branch arms 207*a* and 208*b*. In the embodiment, various types of capacitors, such as a chip capacitor, can be used as the first branch capacitor 208.

The first branch capacitor 208 is disposed at one side of a feeding point about the feeding point.

The first branch capacitor 208 performs a function of controlling a frequency of an RF signal. Specifically, the first branch capacitor 208 performs a function of controlling a high frequency of the RF signal. That is, the first branch capacitor 208 may control a frequency of an RF signal such that the antenna 200 may be operated at a high frequency band.

The third branch arm 209*a* is combined with and extends from the radiator 202, and the fourth branch arm 209*b* is combined with and extends from the ground plane 204. The third and fourth branch arms 209*a* and 209*b* are formed of a conductive material, and the second branch capacitor 210 between the third and fourth branch arms 209*a* and 209*b*. In the embodiment, various types of capacitors, such as a chip capacitor, can be used as the second branch capacitor 210.

The second branch capacitor 210 is disposed at the opposite side of the feeding point about the feeding point.

The second branch capacitor 210 performs a function of controlling a frequency of an RF signal. Specifically, the second branch capacitor 210 performs a function of controlling a low frequency of an RF signal. That is, the second branch capacitor 210 may control a frequency of an RF signal such that the antenna 200 may be operated at a low frequency band.

The first stub 212 may be disposed between the first and second branch capacitors 208 and 210.

The first stub 212 may change a current path and form one resonant frequency band.

The first stub 212 may be a conductive line on a substrate.

One end of the first stub 212 is connected to a circuit end on the substrate, and the other end may be connected to the ground plane 204.

A resonant frequency of the antenna 200 may be controlled according to a length, a width and a gap of the first stub 212.

When the first stub 212 has a rectangular shape, the length of the first stub 212 corresponds to a longitudinal length of the rectangular shape and the width of the first stub 212 corresponds to a horizontal length of the rectangular shape.

The length of the first stub 212 may correspond to a gap between the circuit end of the substrate and the ground plane.

The gap of the first stub 212 may correspond to a gap between the first stub 212 and the first branch capacitor 208, a gap between the first stub 212 and the second stub 214, a gap between the first stub 212 and the first ground line, or a gap between the first stub 212 and the second ground line.

A designer may select a desired resonant frequency of the antenna 200 by selecting the length, width and gap of the first stub 212 when designing the antenna 200.

The second stub 214 may be disposed between the first branch capacitor 208 and the second ground line.

The second stub 214 may form one resonant frequency band by changing a current path.

The second stub 214 may be a conductive line on the substrate.

One end of the second stub 214 may be connected to the circuit end on the substrate, and the other end of the second stub 214 may be connected to the ground plane 204.

The resonant frequency of the antenna 200 may be controlled according to the length, width and gap of the second stub 214.

When the second stub 214 has a rectangular shape, the length of the second stub 214 corresponds to a longitudinal length of the rectangular shape and the width of the second stub 214 corresponds to a horizontal length of the rectangular shape.

The length of the second stub 214 may correspond to a gap between the circuit end of the substrate and the ground plane.

The gap of the second stub 214 may correspond to a gap between the second stub 214 and the first branch capacitor 208, a gap between the first stub 212 and the second stub 214, a gap between the second stub 214 and the first ground line, or a gap between the second stub 214 and the second ground line.

A designer may select a desired resonant frequency of the antenna 200 by selecting the length, width and gap of the second stub 214 when designing the antenna 200.

The positions of the first and second stubs 212 and 214 may be moved by an additional moving means. As the first and second stubs 212 and 214 move, the resonant frequency band may be expanded.

According to the embodiment, the wide band and multiband may be obtained through a plurality of current paths which are formed according to the positions of the first and second branch capacitors 208 and 210 and the first and second stubs 212 and 214. Specifically, the resonant frequency band can be widely expanded.

The antenna 200 according to the embodiment may be directly installed on a rear case of a mobile terminal, so that the antenna 200 integrally formed with the rear case may be implemented. That is, according to the related art, the antenna 200 is disposed on the rear case after the rear case and the antenna 200 are separately fabricated. However, according to the embodiment, the antenna 200 is installed on the rear case at a time, so that the fabrication process is simplified and the fabrication time is reduced.

Figure 3:
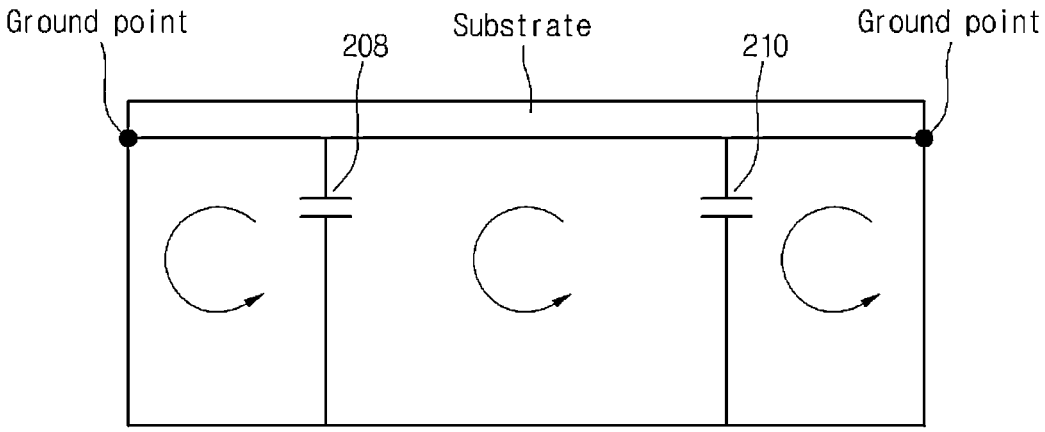
FIG. 3 is a view showing a current path formed in the antenna according to the embodiment.

FIG. 3 is a view showing a current path formed in the antenna 200 according to the embodiment.

FIG. 3 is a view showing the current path additionally formed by using the first and second branch capacitors 208 and 210.

Referring to FIG. 3, when using the first and second branch capacitors 208 and 210, a plurality of current paths may be formed. A plurality of resonant bands may be formed through a plurality of current loops, so that the antenna 200 according to the embodiment may have the characteristics of multiband.

A resonant band formed by a current path may be determined by capacitance values of each branch capacitor. As the capacitance values of the branch capacitors are increased, the resonant band may be formed at a low band. In addition, as the capacitance values of the branch capacitors are decreased, the resonant band may be formed at a high band.

Further, according to the embodiment, when the first and second branch capacitors 208 and 210 do not exist, while a basic resonant frequency formed by the current path of the antenna 200 is maintained, the band width may be expanded due to the plurality of resonant frequency bands formed by the first and second branch capacitors 208 and 210.

Figure 4:
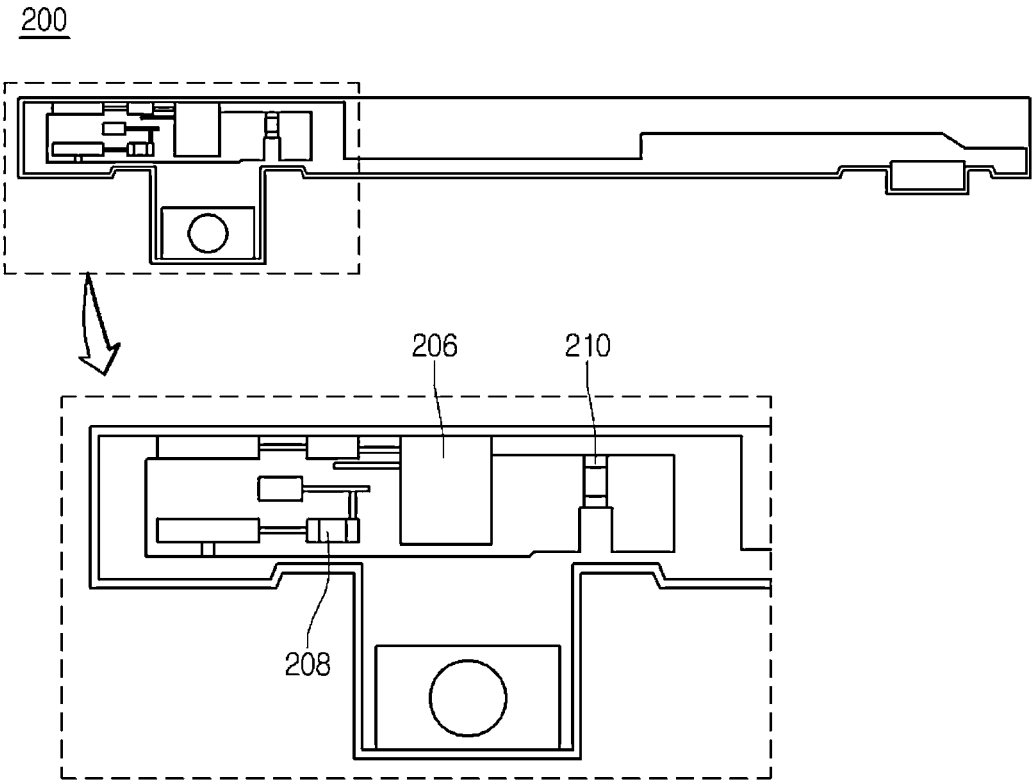
FIG. 4 is a view showing an example of a real structure of an antenna according to the embodiment.

FIG. 4 is a view showing an example of a real structure of an antenna 200 according to the embodiment.

Referring to FIG. 4, the antenna 200 has a pie shape. The antenna 200 may be disposed on the substrate.

Referring to FIG. 4, the first branch capacitor 208 of controlling a high frequency band of an RF signal, a second branch capacitor 210 of controlling a low frequency band of an RF signal, and the feeding pin 206 are disposed.

However, the embodiment is not limited to the disposition of FIG. 4.

Figure 5:
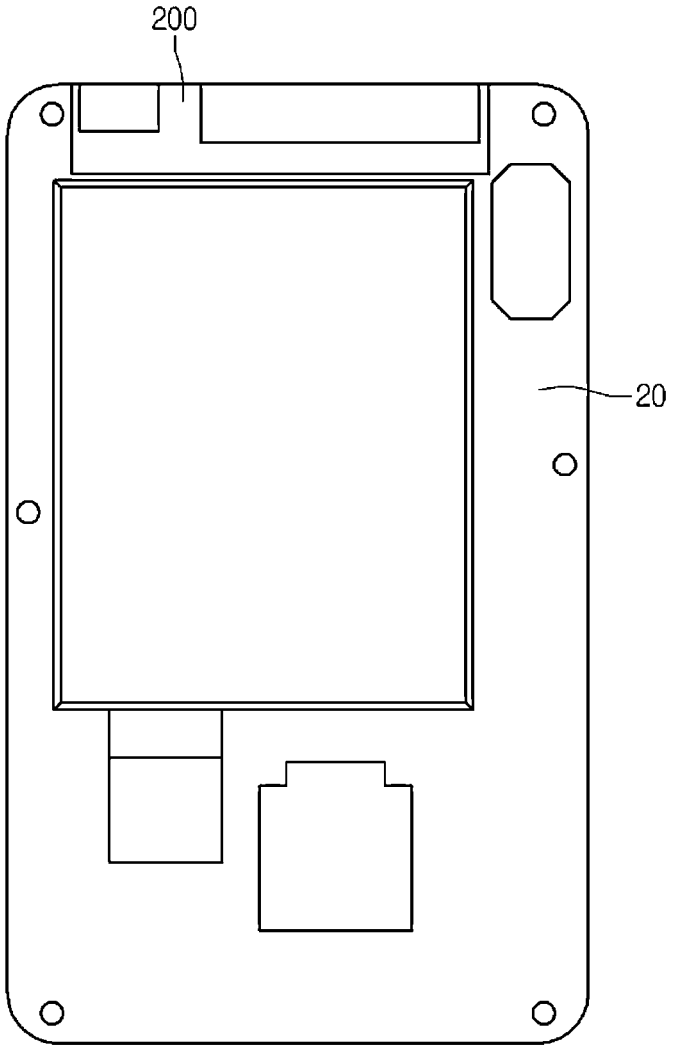
FIG. 5 is a view showing a structure in which an antenna is formed integrally with a rear case.

FIG. 5 is a view showing a structure in which the antenna 200 is integrated with a rear case 20.

Referring to FIG. 5, the antenna 200 according to the embodiment is integrated with the rear case 20 of a mobile terminal.

That is, although the antenna 200 and the rear case 20 are separately fabricated in the related art, the antenna 200 according to the embodiment is integrally formed with the rear case 20 of the mobile terminal.

If the antenna 200 is integrally fabricated on the case 20, the fabrication process is simplified, so that a production rate may be effectively increased.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An antenna comprising:

a radiator;

a ground plane spaced apart from the radiator;

a substrate comprising a circuit formed as a conductive line extending on a top surface of the substrate, the circuit including one end and an opposite end each connected to the ground plane;

a feeding pin for feeding an RF signal to the radiator, and the feeding pin being connected to the circuit;

a first branch reactance disposed between the ends of the circuit, the first branch reactance including one end connected to the circuit and an opposite end connected to the ground plane; and a second branch reactance disposed between the ends of the circuit, the second branch reactance including one end connected to the circuit and an opposite end connected to the ground plane;

a first stub disposed between the first branch reactance and the second branch reactance, forming a signal path of the antenna;

a second stub disposed at one side of the second branch reactance, forming another signal path of the antenna;

wherein a resonant frequency of the antenna is controlled according to at least one of a length and a width of the first stub and a length and a width of the second stub.

2. The antenna of claim 1, wherein the first branch reactance and the second branch reactance form a plurality of signal paths to generate a plurality of resonant frequency bands.

3. The antenna of claim 1, wherein the first branch reactance controls a frequency to allow the antenna to be operated at a high frequency band.

4. The antenna of claim 1, wherein the second branch reactance controls a frequency to allow the antenna to be operated at a low frequency band.

5. The antenna of claim 1, wherein the first branch reactance and the second branch reactance each includes a capacitive element.

6. The antenna of claim 5, wherein the capacitive element includes a chip capacitor.

7. The antenna of claim 1, wherein the resonant frequency of the antenna is controlled according to a gap between the first stub and the first branch reactance or a gap between the second stub and the second branch reactance.

8. The antenna of claim 1, wherein the first and second stubs each includes a conductive line connected to a circuit layer on the substrate.

9. The antenna of claim 1, wherein the antenna is installed at a rear case of a mobile terminal and integrally formed with the rear case.

10. The antenna of claim 1, wherein the substrate is one of a printed circuit board and a flexible printed circuit board.

11. A mobile terminal equipped with the antenna claimed in claim 1.

* * * * *